US005934471A

United States Patent [19]

Jun

[11] Patent Number: 5,934,471

[45] Date of Patent: Aug. 10, 1999

[54] STACKABLE TRAY FOR CONTAINING OFFSET PARTS

[75] Inventor: Hee-il Jun, Suwon, Rep. of Korea

[73] Assignee: Samsung Electronics Co., Ltd., Suwon, Rep. of Korea

[21] Appl. No.: 08/971,337

[22] Filed: Nov. 17, 1997

[30] Foreign Application Priority Data

Jan. 28, 1997 [KR] Rep. of Korea ..... 97-2317

[51] Int. Cl.[6] ..... B65D 21/00; B65D 85/00; B65D 1/36

[52] U.S. Cl. ..... 206/509; 206/562

[58] Field of Search ..... 206/501, 503, 206/509, 499, 203, 562, 563, 327, 459.5; 220/514–519

[56] References Cited

U.S. PATENT DOCUMENTS

| | | | |
|---|---|---|---|
| 2,774,473 | 12/1956 | Williams | 206/422 |
| 3,771,646 | 11/1973 | Mascetti, Jr. | 206/509 X |
| 4,282,975 | 8/1981 | Ovadia | 206/509 X |
| 5,291,998 | 3/1994 | Fiebig | 206/562 X |
| 5,673,792 | 10/1997 | Aikio | 206/509 |
| 5,697,500 | 12/1997 | Walker | 206/509 |

*Primary Examiner*—Bryon P. Gehman

*Attorney, Agent, or Firm*—Burns, Doane, Swecker & Mathis, L.L.P.

[57] ABSTRACT

Parts are arranged in a stack of trays disposed atop one another. The parts are positioned such that a lower portion of each part is disposed within one of the trays, and an upper portion of each part projects into a recess formed in the next upper tray. The trays are of identical configuration and adjacent trays are angularly offset with respect to one another.

3 Claims, 4 Drawing Sheets

STACKABLE TRAY FOR CONTAINING OFFSET PARTS

BACKGROUND OF THE INVENTION

1) Field of the Invention

The present invention relates to a tray for containing parts, and more particularly to a tray used for containing relatively bulky (especially, tall) parts such as a motor or a clutch assembly for a washing machine.

2) Description of the Prior Art

A parts-carrying tray generally comprises a box-shaped container used for retaining parts, such as semiconductor devices liable to be damaged due to external factors, or bulky and heavy parts which are not easily fed by mechanical equipment.

Such a tray is typically formed with a part receiving section in the upper plane thereof to be suited to the shape of the parts which are to be received, so that the parts are aligned into the part receiving section for being stored or transported. Parts which are not easily fed in an automatization line by mechanical feeding equipment such as a robot, are fed while seated in the tray.

FIGS. 1 and 2 show a conventional tray for containing parts. Referring to FIGS. 1 and 2, conventional tray 10 is formed by a tray base (13) and a tray sidewall (14). Tray base (13) is formed with a plurality of part receiving sections (12) conforming to the shape of parts (11) which are to be contained by the tray (10). Tray sidewall (14) extends upwardly from the outer periphery of tray base (13) to make a box shape in cooperation with tray base (13).

Tray sidewall (14) is formed with a concave step section (16) in the upper portion thereof for being capable of receiving a convex step section (15) formed on the lower portion of the next upper tray (10) in a stack of trays (10). Therefore, the stacking procedure of trays (10), as shown in FIG. 2, is performed such that convex step section (15) of upper tray (10) is inserted into concave step section (16) of underlying tray (10). When parts (11) such as a motor or a clutch assembly for a washing machine are fed to a washing machine assembly line, they are typically fed while contained within multi-layered trays (10).

However, since conventional tray (10) formed as described above must be high enough to fully embrace part (11) which is to be contained therein, it results in a tray (10) of increased height. In other words, the number of trays (10) capable of being stacked within a confined space is small, and the manufacturing cost of products is increased.

SUMMARY OF THE INVENTION

Therefore, it is an object of the present invention to provide a tray for containing parts for enabling relatively more trays to be stacked within a confined space.

To achieve the above object of the present invention there is provided a stackable tray for containing parts. The tray comprises a body and a sidewall. The body includes upper and lower portions. One of the upper and lower portions includes a first mating configuration, and the other of the upper and lower portions includes a second mating configuration adapted to mate with a first mating configuration of another, identically shaped tray. The body further includes at least one downwardly projecting first recess configured to receive a lower portion of a part, and at least one upwardly projecting second recess configured for receiving an upper portion of the part. The first and second recesses are horizontally offset from one another.

The invention further relates to the combination of a stack of at least first and second ones of such trays, and parts contained therein.

The invention also relates to a method of arranging parts in a stack of at least first and second trays, the second tray disposed atop the first tray. The method comprises positioning the parts such that a lower portion of each part is disposed within the first tray, and an upper portion of each part projects into a recess formed in the second tray.

By employing the tray for containing parts according to the present invention described as above, the upper portions of the parts contained within the part receiving sections of the underlying tray are received into the recesses formed in the lower plane of the tray base of the upper tray when at least two trays are rotated by 180° to be alternately stacked. By this construction, the tray need not be high enough to receive the entire height of a part. Hence, the inherent height of the tray can be decreased and more trays can be stacked within a given space.

Also, since the tray for containing parts according to the present invention described as above is furnished with tray stacking direction identifying sections on two opposing walls of the tray sidewall, the stacking direction of the trays can be easily identified by sensing means such as a sensor. Therefore, the tray can be applied to an assembling automatization of the products in an automatization line using a machine equipment such as a robot.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

Figure 1:
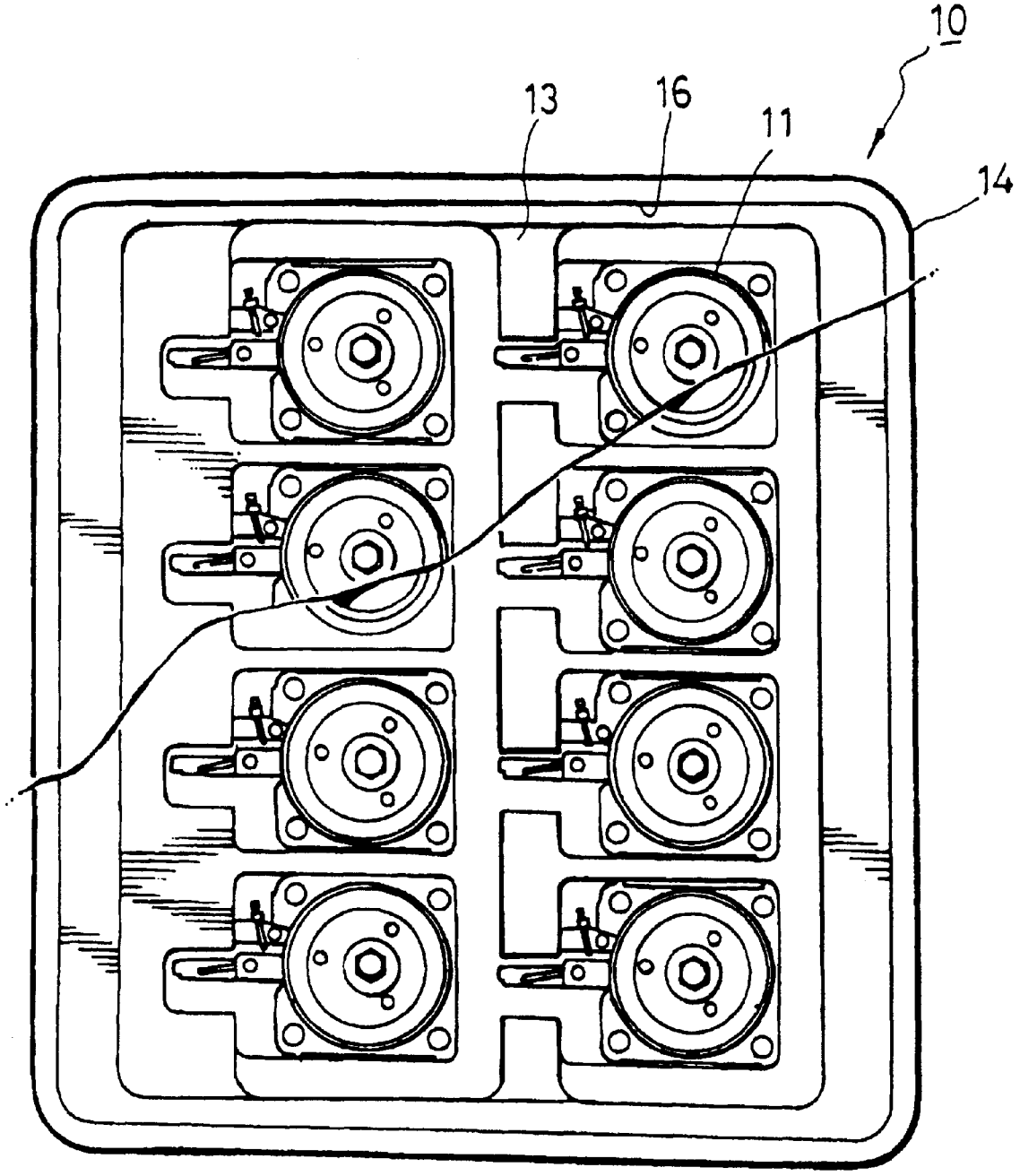
FIG. 1 (Prior Art)
FIG. 1 is a plan view with portions broken away for showing a stacking condition of the conventional trays for containing parts.
Figure 2:
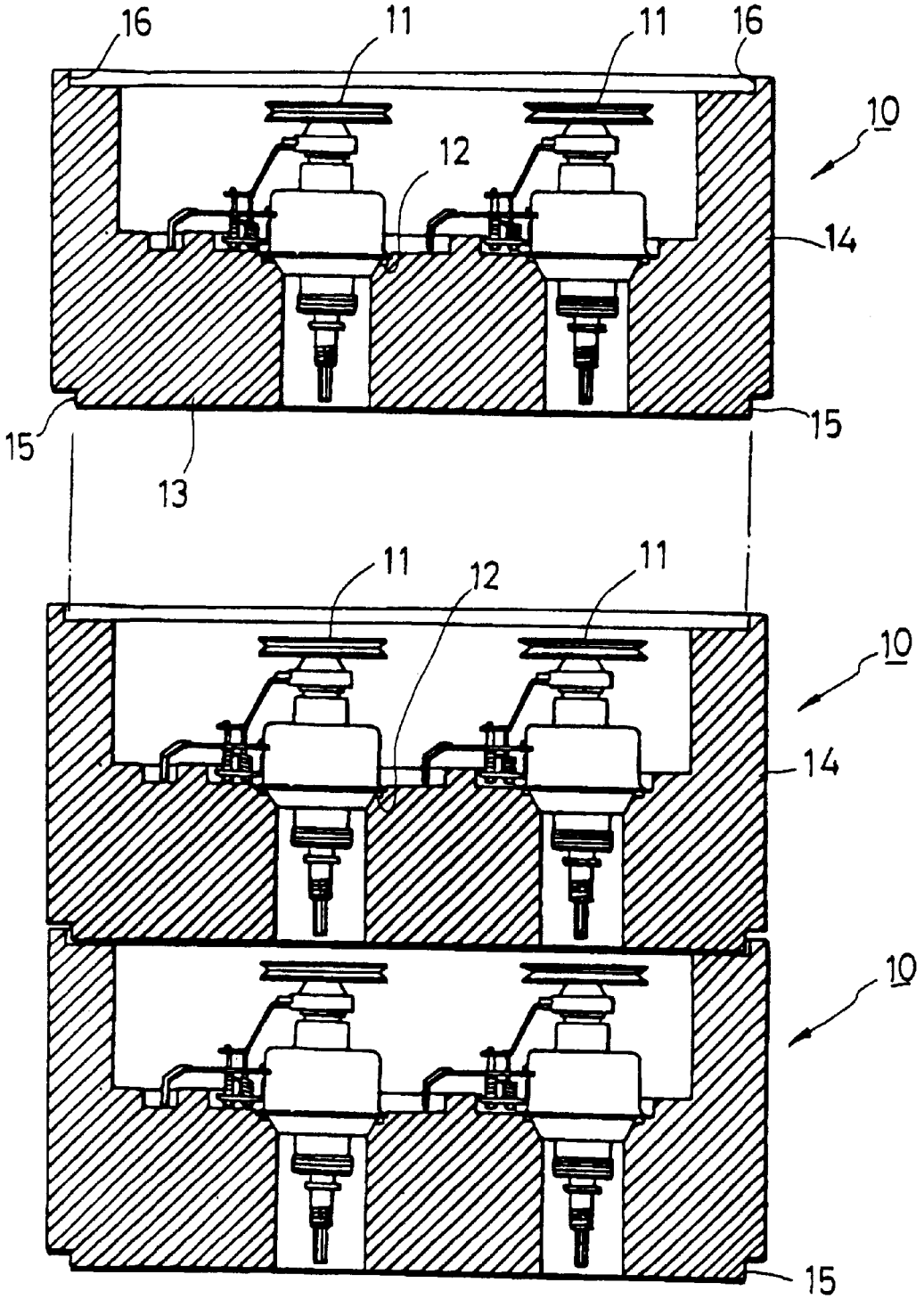
FIG. 2 (Prior Art)
FIG. 2 is a side section view showing a stacking condition of the conventional trays for containing parts.
Figure 3:
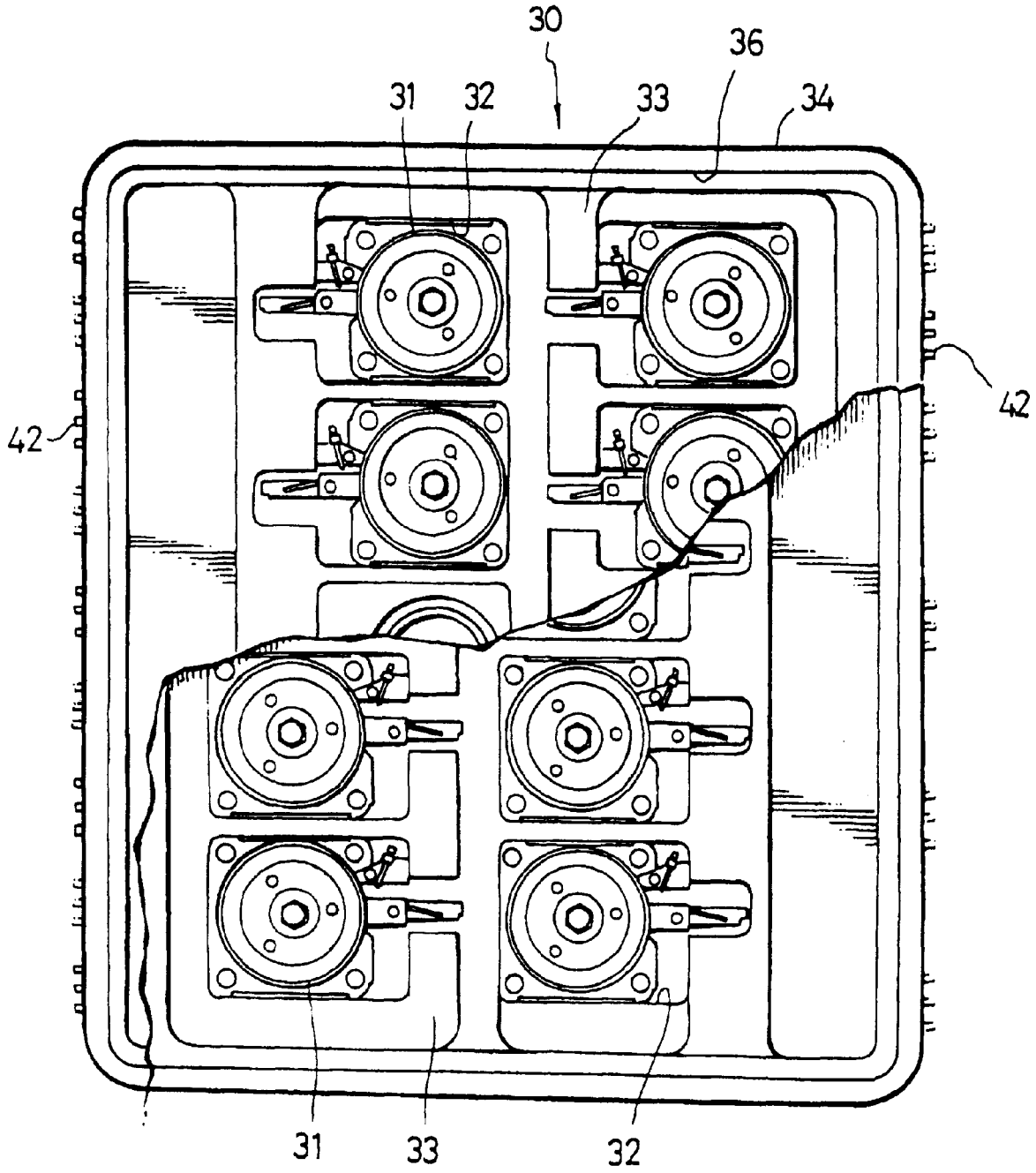
FIG. 3 is a plan view with portions broken away for showing a stacking condition of the trays for containing parts according to the present invention.
Figure 4:
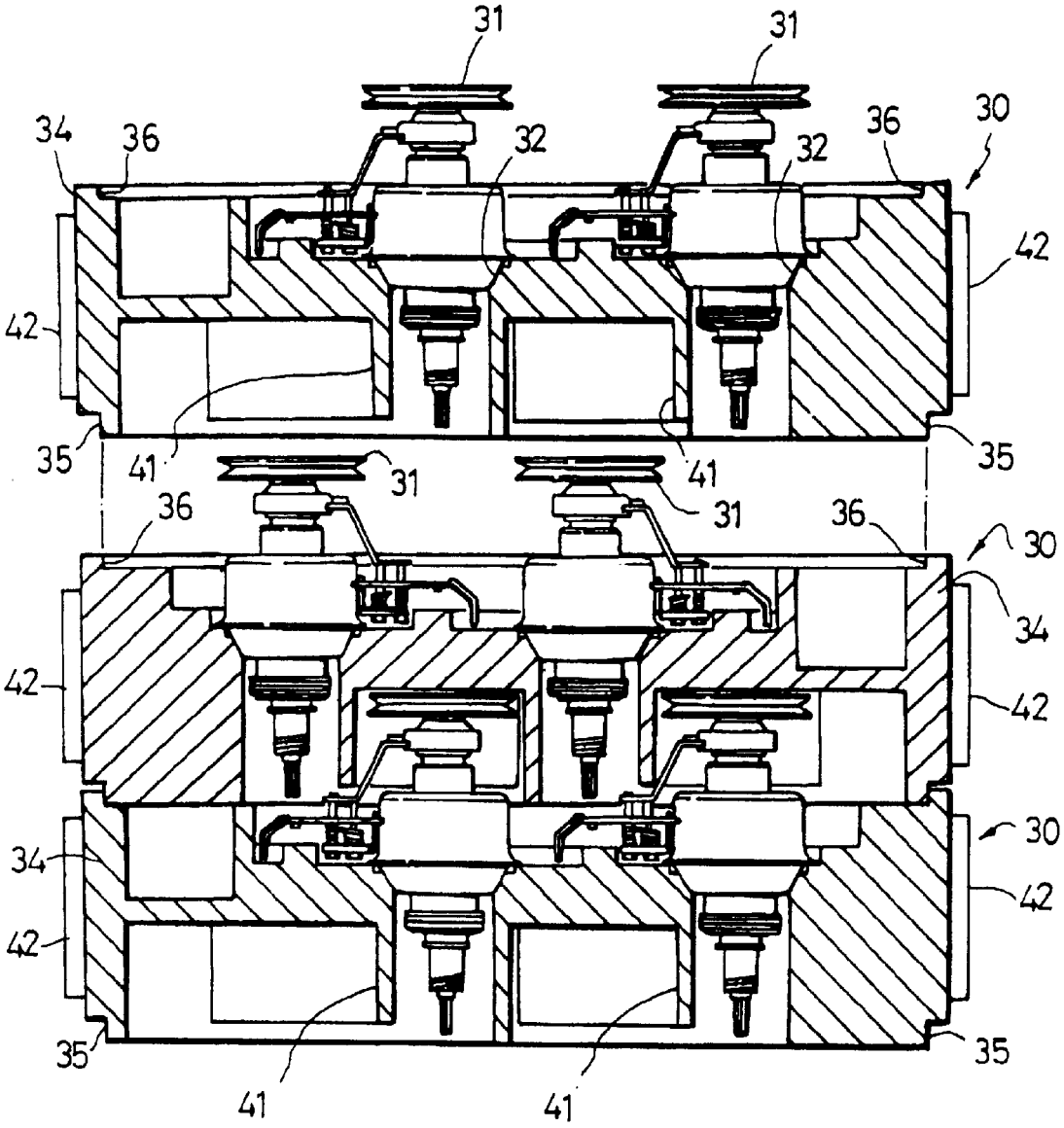
FIG. 4 is a side section view showing a stacking condition of the trays for containing parts according to the present invention.

FIGS. 3 and 4 illustrate a tray for containing parts according to the present invention. Referring to FIGS. 3 and 4, a tray (30) for containing parts is formed by a tray base (33) and a tray sidewall (34).

Tray base (33) is formed with a plurality of part-receiving recesses or sections (32) each conforming to the shape of a part (31) which is to be aligned thereon. Tray sidewall (34) extends upwardly from the outer periphery of tray base (33) to make a box shape in cooperation with tray base (33).

The part-receiving sections (32) are asymmetrically arranged relative to the vertical center axis of tray (30). Tray base (33) is formed with a plurality of recesses (41) in the bottom plane thereof, so that when two trays (30) are rotated by 180° relative to one another and thus are angularly offset, and then are alternately stacked, the upper portions of parts (31) contained in part receiving sections (32) of underlying tray (30) can be received in recesses (41) of the next upper tray.

Tray stacking direction identifying sections (42) protrude from the outer sides of two opposing walls of tray sidewall (34). Tray stacking direction identifying sections (42) are arranged to be disposed at different positions when trays (30) are offset by 180° to be alternately stacked.

A concave step section (36) is formed in the upper portion of tray sidewall (34) defines a first mating configuration for receiving a second mating configuration in the form of a convex step section (35) formed in the lower portion of the next upper tray (30) when stacking trays (30). Thus, trays (30) are stacked in a manner that a convex step section (35) of each tray is inserted into a concave step section (36) of an underlying tray (30).

During the feeding of parts (31) such as the motors or clutch assemblies of washing machines to an automatization line while the parts are contained in trays (30), at least two trays (30) contained with parts (31) are fed to the automatization line while angularly offset by 180° and alternately stacked. At this time, the upper portions of parts (31) disposed in the part receiving section (32) of the underlying tray (30) project into respective recesses (41) of upper tray (30).

As a result, each tray (30) for containing parts according to the present invention does not have to be high enough to enclose the entire height of a part (31), so the inherent size of tray (30) can be reduced, and more trays (30) can be stacked within a confined space.

Furthermore, tray (30) for containing parts according to the present invention is provided with tray stacking direction identifying sections (42), so that the stacking direction of tray (30) can be easily identified by sensing means such as a sensor. Therefore, the trays can be applied to automated mechanical equipment such as robots.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. A stackable tray for containing parts, the tray comprising a base and a sidewall, the sidewall including upper and lower portions, the lower portion forming a convex step and the upper portion forming a concave step to receive and support the convex step of another identically shaped tray; the base including at least one downwardly projecting first recess configured to receive a lower portion a respective one of the parts, and at least one downwardly open second recess for receiving an upper portion of a respective one of the parts, the at least one first recess being horizontally offset from the at least one second recess the at least one first recess and the at least one second recess being asymmetrically arranged with respect to a vertical center axis of the tray; wherein the base is of generally rectangular shape when viewed in plan; the sidewall comprising a series of walls arranged at an angle with respect to one another, a first of the walls having first visual indicators disposed on an exterior surface thereof, a second of the walls disposed opposite the first wall having second visual indicators disposed on an exterior surface thereof, the positional relationship of the first visual indicators with respect to the first wall being different than the positional relationship of the second visual indicators with respect to the second wall, to enable a sensor to distinguish between the first and second walls.

2. In combination, a vertical stack of identically configured trays, and parts contained in each of the trays; each tray comprising a base and a sidewall, the sidewall including upper and lower portions, the lower portion forming a convex step and the upper portion forming a concave step, the convex step of each tray being seated in the concave step of the tray disposed therebeneath, whereby each tray is supported by the sidewall of the tray disposed therebeneath; the base of each tray including a plurality of first recesses in which lower portions of respective parts are seated, with upper portions of the parts projecting above the base and above the sidewall of the respective tray; the base of each tray further including a plurality of second recesses opening in a downward direction and receiving the upper portions of respective parts seated in the tray disposed therebeneath, the first recesses being horizontally offset from the second recesses and asymmetrically arranged with respect to a vertical center axis of the tray; wherein the base is of generally rectangular shape when viewed in plan; the sidewall comprising a series of walls arranged at an angle with respect to one another, a first of the walls having first visual indicators disposed on an exterior surface thereof, a second of the walls disposed opposite the first wall having second visual indicators disposed on an exterior surface thereof, the positional relationship of the first visual indicators with respect to the first wall being different than the positional relationship of the second visual indicators with respect to the second wall, to enable a sensor to distinguish between the first and second walls.

3. The combination according to claim 2 wherein lower ends of the parts extend no lower than bottom ends of the first recesses in which the parts are seated.

* * * * *